United States Patent [19]

Oppelt et al.

[11] Patent Number: 4,700,905

[45] Date of Patent: Oct. 20, 1987

[54] ARRANGEMENT FOR TAPE WINDING MACHINES FOR THE COMPENSATION OF A UNILATERAL TAPE TENSION

[75] Inventors: Herbert Oppelt, Frensdorf; Rufolf Lechner, Stegaurach-Kreuzschun, both of Fed. Rep. of Germany

[73] Assignee: MWB Messwandler-Bau AG, Bamberg, Fed. Rep. of Germany

[21] Appl. No.: 6,349

[22] Filed: Jan. 14, 1987

Related U.S. Application Data

[63] Continuation of Ser. No. 760,939, Jul. 31, 1985, abandoned.

[30] Foreign Application Priority Data

Aug. 3, 1984 [DE] Fed. Rep. of Germany ..... 3428707

[51] Int. Cl.[4] ..... B65H 17/02; B65H 23/16

[52] U.S. Cl. ..... 242/67.1 R; 242/75.3

[58] Field of Search ..... 242/76, 75.2, 75.3, 242/67.1 R, DIG. 2; 226/196, 195

[56] References Cited

U.S. PATENT DOCUMENTS

| | | | |
|---|---|---|---|
| 745,240 | 11/1903 | Rolland, Jr. | 242/75.3 |
| 2,055,785 | 9/1936 | Crowther | 242/67.1 R |
| 2,066,307 | 12/1936 | Horton | 242/75.3 |
| 2,568,431 | 9/1951 | Congdon | 242/67.1 R |
| 2,989,265 | 6/1961 | Selsted | 242/76 |
| 3,140,033 | 7/1964 | Zivny | 226/196 |
| 3,795,370 | 3/1974 | Dean | 242/67.1 R |
| 3,851,839 | 12/1974 | Hynes | 242/75.3 X |
| 3,997,095 | 12/1976 | Lamb | 226/195 |
| 4,360,356 | 11/1982 | Hall | 242/75.2 X |
| 4,477,035 | 10/1984 | O'Connor | 242/67.1 R |

*Primary Examiner*—Stuart S. Levy
*Assistant Examiner*—Thomas R. Hannon
*Attorney, Agent, or Firm*—Barnes & Thornburg

[57] ABSTRACT

An arrangement for tape winding machines for the compensation of a unilateral tape tension of tapes to be wound which can be easily attached to a winding machine or integrated into the same. This is achieved in that the arrangement consists of a compensating roller (6) provided between a transfer roller (4) and a fixedly arranged delivery edge or a brake guide roller (3), as viewed in the direction of movement of the tape. The compensating roller (6) is freely movably supported in a guidance (10, 10') in such a manner that the axis of rotation (7) of the compensating roller (6) can tilt from its position parallel to the plane formed between the transfer roller (4) and the delivery edge, respectively, guide roller (3) and is able to subject the tape (1) to a torsional force (twisting) corresponding to the unilateral tape tension.

25 Claims, 5 Drawing Figures

ARRANGEMENT FOR TAPE WINDING MACHINES FOR THE COMPENSATION OF A UNILATERAL TAPE TENSION

This is a continuation of application Ser. No. 760,939, filed July 31, 1985, now abandoned.

BACKGROUND AND SUMMARY OF THE INVENTION

The present invention relates to an arrangement for tape or strip winding machines for the compensation of a one-sided tape tension of tapes or strips to be wound.

During the winding of tapes, a one-sided tape tension occurs in case of a not-completely planar winding surface, as a result of which the tape either will go astray and/or folds will form on the side with lesser tape tension.

An installation is to be provided by the present invention which can be easily attached to a winding machine or integrated into the same and by means of which the aforementioned shortcomings are avoided.

The underlying problems are solved according to the present invention in that a compensating roller is provided between a transfer roller and a fixedly arranged delivery edge or a braked guide roller, as viewed in the direction of movement of the tape, and in that the compensating roller is supported in a guidance freely movably in such a manner that the axis of rotation of the compensating roller can tilt from its position parallel to the plane formed between and defined by the transfer roller and the delivery edge, respectively, guide roller, and is thereby able to subject the tape to torsional forces (twisting) corresponding to the one-sided tape tension.

A completely satisfactory, accurate tape winding with predetermined, also variable pitch is attained by the freely movably supported compensating roller is conjunction with the fixed delivery edge. This effect occurs even when one switches from one pitch during the winding in one coil direction to a reverse pitch during the winding in the other coil direction. It has been found surprisingly that this effect occurs only when the tape is strongly braked on the delivery side as is the case with a fixed delivery or contact edge.

These and other objects, features and advantages of the present invention will become more apparent from the following description when taken in connection with the accompanying drawing which shows, for purposes of illustration only, one embodiment in accordance with the present invention, and wherein:

DETAILED DESCRIPTION OF THE DRAWING

Figure 1:
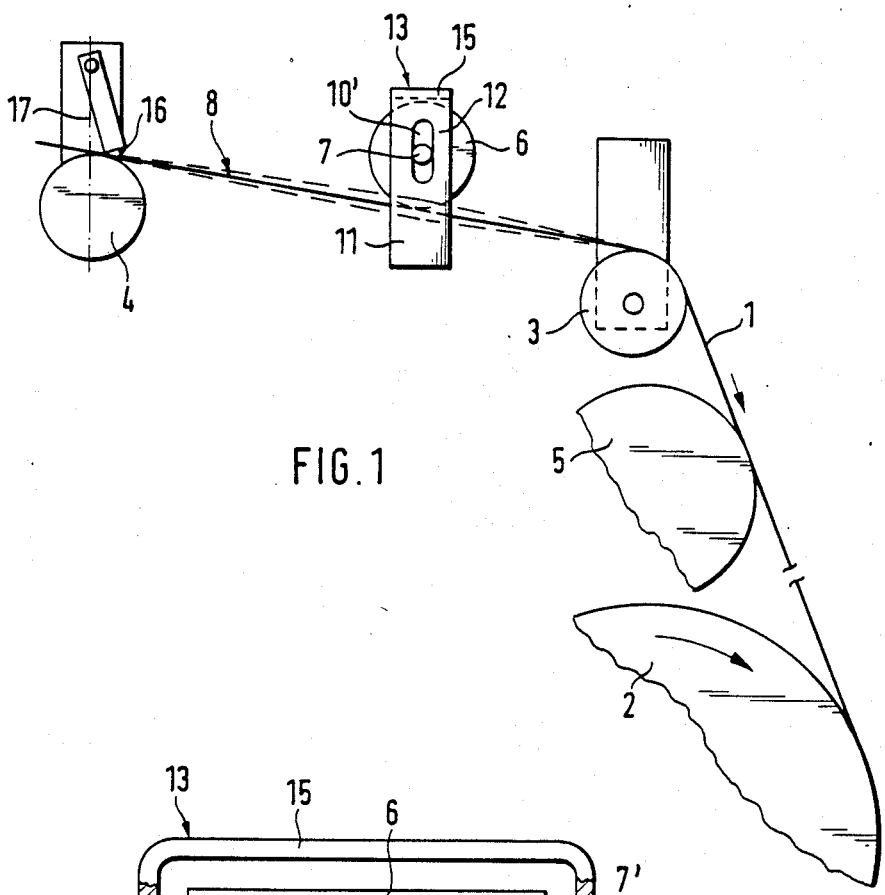
FIG. 1 is a somewhat schematic side elevational view of the arrangement in principle according to the present invention.

Referring now to the drawing wherein like reference numerals are used throughout the two views to designate like parts, reference numeral 1 designates a tape or strip to be wound, for example, an insulating tape for electric coils, chokes, transformers, instrument transformers or the like. It is wound on a coil body 2 and is thereby normally withdrawn by way of a guide roller 3 and a transfer roller 4 from a supply roller (not shown). An idler roller 5 may additionally be provided between the coil body 2 and the guide roller 3. Advantageously, however, the guide roller 3 is provided near the coil body 2 and possibly their distance from one another can be automatically readjusted.

Figure 2:
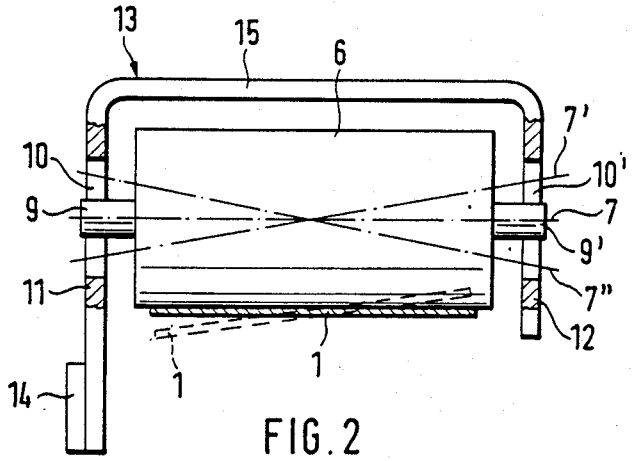
FIG. 2 is a front elevational view, partly in cross section, of the compensating roller in its guidance.

According to the present invention, an arrangement consisting of a freely movably supported compensating roller 6 is provided between the guide roller 3 and the transfer roller 4 for compensating an uneven unilateral tape tension. The compensating roller 6 is so supported that the axis of rotation 7 of the compensating roller 6 is able to pivot from its position normally parallel to the plane 8 formed between and defined by the transfer roller 4 and the guide roller 3—respectively, parallel to the bearing edges of these rollers—into a position inclined to one of the two sides. The inclined end positions 7', respectively, 7'' are indicated as examples in FIG. 2. As a result of this free support of the compensating roller 6, the tape running underneath the same can be twisted depending on the unilateral tape tension as indicated in dash lines in FIG. 1.

Figure 3:
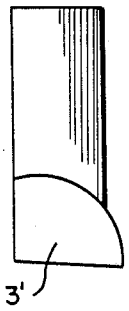
FIG. 3 is a view of a fixed bearing edge.
Figure 4:
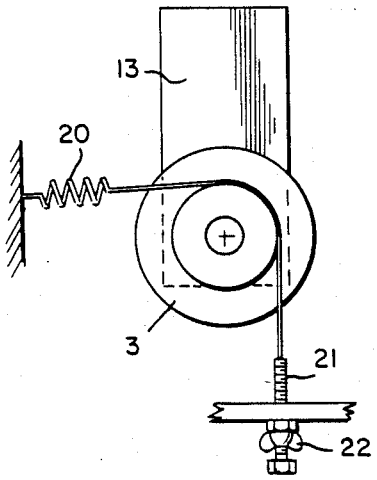
FIG. 4 is a view of a controllable braking device.
Figure 5:
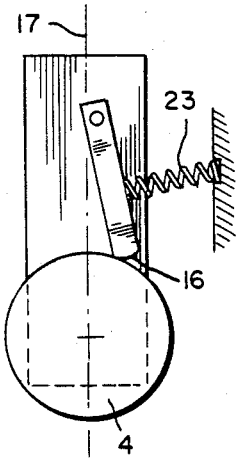
FIG. 5 is a view of prestressed blocking web.

For a completely satisfactory winding of the tape 1, additionally either the guide roller 3 is rigidly secured or is provided with or coupled to a preferably adjustable and/or controllable braking device illustrated in FIG. 4, or a fixed bearing edge with a rounded bearing surface illustrated in FIG. 3 is provided corresponding to that of a guide roller and all of which provide a deliver surface fixed during winding. The radius of curvature of the bearing surface or the braking action of the brake is to be matched to the material to be wound, i.e., with a stiff tape, the bearing surface has a larger radius in order that the tape is not bent or buckled, yet the requisite braking action occurs. Without such braking, the compensating roller 6 cannot completely fulfill its task. Likewise, the weight must be matched to the material properties and dimensions. The width of the compensating roller 6 is preferably somewhat larger than the width of the tape 1, however, it may also be exactly as wide as the tape.

The free support of the compensating roller 6 is achieved by the support of the laterally projecting bearing shafts 9 and 9' in at least approximately vertical longitudinal slots 10 and 10' of legs of a bow-shaped support member 13 forming bearing webs 11 and 12. The compensating roller 6 is rotatably and displaceably supported in these longitudinal slots 10 and 10'.

The one bearing web, respectively, leg 11 is extended and is provided laterally with a groove or a tongue of a tongue-and-groove guidance or with the one part of a dovetail guidance 14 which serves for the positionally accurate fastening at a machine part.

In particular, the bow-shaped support member 13 is attached by means of an upwardly directed connecting web 15 or is adapted to be so attached that the tape 1 does not have to be threaded.

According to an advantageous construction of the present invention, the transfer roller 4 located ahead of the compensating roller 6 is provided with a tape backstop preventing the return movement of the tape. This backstop consists of a tape clamping device which during an undesired return movement of the tape 1, automatically clamps the same between the transfer roller 4 and a blocking web 16 pivotally secured above the tape 1. The blocking web 16 thereby rests on the tape 1 in front of the vertical 17, as viewed in the direction of tape movement, under its own weight or/and behind an inclined prestress.

This arrangement is appropriately attached to a feed arm of a coil winding machine which is able to wind the tape layers on the coil body 2 with a desired pitch. Completely smooth wrappings are attainable thereby also with an overlap of the individual windings of a tape layer, i.e., the one-sided tape tension which occurs with this type of winding is compensated by the twisting of the tape 1 ahead of the delivery edge, respectively, guide roller 3.

The guide roller 3 and the transfer roller 4 are constructed as cylinder rollers and are mounted in parallel to the coil body 2. With the use of contact surfaces in lieu of the rollers, the contact surfaces are also rectilinear parallel to the coil body 2.

While we have shown and described only one embodiment in accordance with the present invention, it is understood that the same is not limited thereto but is susceptible of numerous changes and modifications as known to those skilled in the art, and we therefore do nt wish to be limited to the details shown and described herein but intend to cover all such changes and modifications as are encompassed by the scope of the appended claims.

We claim:

1. An arrangement for tape winding machines to compensate for a unilateral tape tension of tapes to be wound with a desired slope or overlap, comprising a transfer roller means on a feeding side, a delivery surface means fixed during winding on a delivery side, a compensating roller means arranged between said transfer roller means and said delivery surface means, as viewed in the direction of movement of the tape, and resting on tape extending under tension in a plane between said transfer roller means and said delivery surface means without significantly pressing through the plane, said compensating roller means being of a sufficient weight and freely movably supported in a guide means in such a manner that the axis of the rotation of the compensating roller means is able to incline from its position parallel to said plane formed between the transfer roller means and the delivery surface means and is thereby able to twist the tape to compensate for the unilateral tape tension.

2. An arrangement according to claim 1, wherein said delivery surface means is formed by a bearing edge.

3. An arrangement according to claim 1, wherein said delivery surface means is formed by a braked guide roller means.

4. An arrangement according to claim 1, wherein said guide means includes two bearing webs provided with at least nearly vertical longitudinal slots in which laterally projecting bearing shafts of the compensating roller means are rotatably and vertical and pivotable displaceably supported, said slots preventing the displacement of the compensating roller means from significantly pressing through said plane.

5. An arrangement according to claim 1, wherein said transfer roller means is constructed rotatable.

6. An arrangement according to claim 1, wherein said transfer roller mens is provided with a return movement-blocking means.

7. An arrangement according to claim 6, wherein the return movement-blocking means includes a pivotal blocking web resting on the tape from above at least under its own weight and leading with respect to the vertical, as viewed in the direction of movement of the tape.

8. An arrangement according to claim 7, wherein said blocking web rests on the tape under prestress.

9. An arrangement according to claim 1, wherein said transfer roller means is formed by a bearing surface means.

10. An arrangement according to claim 1, wherein the width of the compensating roller means corresponds at least to that of the tape to be wound.

11. An arrangement according to claim 1, wherein the arrangement is mounted on a feed arm of a coil winding machine and serves for the compensation of unilateral tape tension which occurs with a change of the winding pitch.

12. An arrangement according to claim 1, wherein the delivery space means and the transfer roller means are constructed as cylinder rollers aligned parallel to one another.

13. An arrangement according to claim 1, wherein with fixed bearing surface means forming at least one of delivery surface means and transfer roller means, said bearing surface means extend parallelly and rectilinearly.

14. An arrangement according to claim 1, wherein the weight of said compensating roller is a function of the properties and density of the material being wound.

15. An arrangement for tape winding machines to compensate for a unilateral tape tension of tapes to be wound with a desired slope or overlap, comprising a transfer roller means on a feeding side, a delivery surface means fixed during winding on a delivery side, a compensating roller means arranged between said transfer roller means and said delivery surface means, as viewed in the direction of movement of the tape, said compensating roller means being of a sufficient weight and freely movably supported in a guide means in such a manner that the axis of the rotation of the compensating roller means is able to incline from its position parallel to the axis of the transfer roller means and the delivery surface means and is thereby able to twist the tape to compensate for the unilateral tape tension, said guide means including two bearing webs provided with at least nearly vertical longitudinal slots in which laterally projecting bearing shafts of the compensating roller means are rotatably and vertical and pivotable displaceably supported, said bearing webs being legs of a bow-shaped support member having a connecting web arranged above the compensating roller means.

16. An arrangement according to claim 15, wherein one leg is extended and serves for fastening at a bearer means.

17. An arrangement according to claim 15, wherein said transfer roller means is constructed rotatable.

18. An arrangement according to claim 17, wherein said transfer roller means is provided with a return movement-blocking means.

19. An arrangement according to claim 18, wherein the return movement-blocking means includes a pivotal blocking web resting on the tape from above at least under its own weight and leading with respect to the vertical, as viewed in the direction of movement of the tape.

20. An arrangement according to claim 19, wherein said blocking web rests on the tape under prestress.

21. An arrangement according to claim 18, wherein said transfer roller means is formed by a bearing surface means.

22. An arrangement according to claim 18, wherein the width of the compensating roller means corresponds at least to that of the tape to be wound.

23. An arrangement according to claim 18, wherein the arrangement is mounted on a feed arm of a coil winding machine and serves for the compensation of unilateral tape tension which occurs with a change of the winding pitch.

24. An arrangement according to claim 18, wherein the delivery surface means and the transfer roller means are constructed as cylinder rollers aligned parallel to one another.

25. An arrangement according to claim 18, wherein with fixed bearing surface means forming at least one of delivery surface means and transfer roller means, said bearing surface means extend parallelly and rectilinearly.

* * * * *